US008719974B2

(12) United States Patent
Empey

(10) Patent No.: US 8,719,974 B2
(45) Date of Patent: May 13, 2014

(54) SHOWER BARRIER APPARATUS WITH ACCESS MECHANISM

(76) Inventor: Pauline Empey, Milwaukie, OR (US)

( * ) Notice: Subject to any disclaimer, the term of this patent is extended or adjusted under 35 U.S.C. 154(b) by 95 days.

(21) Appl. No.: 12/763,954

(22) Filed: Apr. 20, 2010

(65) Prior Publication Data

US 2011/0252560 A1 Oct. 20, 2011

(51) Int. Cl.
*A47K 3/08* (2006.01)

(52) U.S. Cl.
USPC ..... 4/558

(58) Field of Classification Search
USPC ..... 4/538, 555, 557–558, 596, 604, 4/607–608
See application file for complete search history.

(56) References Cited

U.S. PATENT DOCUMENTS

| | | | | |
|---|---|---|---|---|
| 2,668,298 | A * | 2/1954 | Kimmons | 4/608 |
| 5,448,786 | A * | 9/1995 | Anderson | 4/557 |
| 5,790,992 | A * | 8/1998 | Ray | 4/599 |
| 5,970,536 | A * | 10/1999 | Suarez | 4/599 |
| 7,325,260 | B1 * | 2/2008 | Hoyt | 4/615 |
| 7,946,307 | B2 * | 5/2011 | Zheng | 135/96 |
| 2007/0199143 | A1 * | 8/2007 | Cunningham et al. | 4/558 |

* cited by examiner

*Primary Examiner* — Lori Baker
(74) *Attorney, Agent, or Firm* — Kolisch Hartwell, P.C.

(57) ABSTRACT

A shower barrier, such as a curtain, is provided with a mechanism to hang the shower barrier next to a shower recess or stall. The shower barrier restricts water from exiting the shower recess and includes an access opening for a caretaker to access a patient through the access opening and assist the patient in showering. The access opening may include an elastic reinforcement around its circumference and a flap to cover the opening when not in use by the caretaker.

20 Claims, 6 Drawing Sheets

SHOWER BARRIER APPARATUS WITH ACCESS MECHANISM

FIELD

Embodiments of the invention relate generally to the field of home hygiene, hospital, and healthcare related products and more particularly, to a shower barrier apparatus having an access opening or mechanism therethrough.

BACKGROUND

Providing for the health and well being of healthcare patients, be it in a hospital, residential multi-unit living facility, or in a private home of such a patient, is a noble and honored profession tendered by a veritable army of home nurses, caretakers, aids, and family members, to provide the necessary care for persons of our community who are unable to fully care for themselves.

One of the most important roles of such caretakers provide for the personal hygienic needs of their patients, including assisting patients with showering. Although the degree of mobility of patients varies across a spectrum, and thus the manner in which any particular patient may be bathed likewise varies, a large percentage of patients are sufficiently mobile that they are able to make use of a shower, but require the aid of a caretaker.

Showering, a seemingly simple and mundane task to those who are fortunate enough not to require the aid of a caretaker, brings with it a multitude of problems and complexities when involving a patient and a caretaker. For example, human nature and societal conventions serve to create a angst in the minds of patients due to the necessity to remove one's clothes to shower, and thus, becoming exposed to the caretaker. Additionally, use of a conventional shower barrier forecloses a caretaker's access to the patient, thus creating other logistical and safety related problems, some of which are described in more detail below.

Accordingly, an improved shower barrier apparatus having an access opening or mechanism therethrough is disclosed to overcome or mitigate some of the problems associated with conventional shower barriers.

BRIEF DESCRIPTION OF THE DRAWINGS

Embodiments of the present invention are illustrated by way of example, and not by way of limitation, and can be more fully understood with reference to the following detailed description when considered in connection with the figures in which.

DETAILED DESCRIPTION

Figure 1:
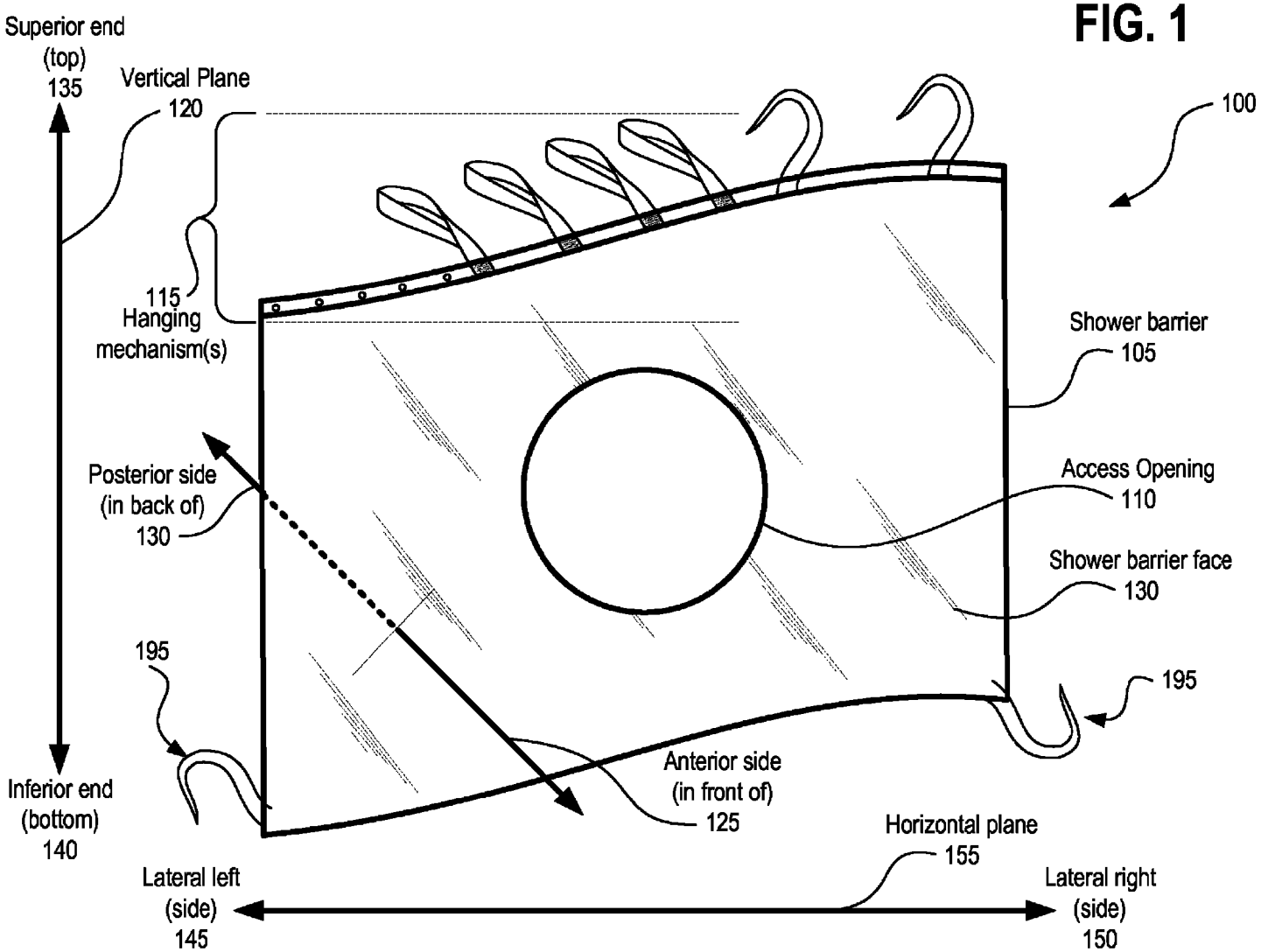
FIG. 1 illustrates an exemplary architecture in which embodiments of the present invention may operate.

Described herein are apparatuses, systems, and methods including a shower barrier having a mechanism to hang in a vertical plane anterior to a shower recess, in which the shower barrier includes an access opening through a face of the shower barrier, where the shower barrier is to restrict water interior to the shower recess from exiting from the shower recess. In one embodiment, the shower barrier is moved aside horizontally to permit ingress of a showeree into the shower recess, a showeree is aided into the shower recess, the shower barrier is returned to its hanging position in the vertical plane anterior to the shower recess, and the showeree is accessed, through the access opening of the shower barrier, to shower the showeree. In an embodiment, a shower bag is further used to deflect a water flow from a shower sprayer while the shower bag is in a collapsed orientation. In an elongated or un-collapsed orientation, the shower bag allows the water flow to spray un-affected or un-deflected from the shower sprayer.

In a particular embodiment, a home healthcare nurse, aid, or caretaker providing hygienic care for a patient, aids the patient into the shower recess and showers the patient by accessing the patient through the access opening in the face of the shower barrier. In such a way, water inside the shower is substantially restricted from exiting he shower recess, substantially mitigating water from accumulating on the floor exterior to the shower opening, and thus improving the safety of the working environment for both the caretaker and the patient (e.g., less water on the floor makes the caretaker less apt to slip and fall), and further substantially mitigating water from interior to the shower recess from exiting the shower recess and saturating the caretaker and the caretaker's clothes and shoes, while the caretaker remains exterior to the shower recess, with the exception of, for example, the arms and hands of the caretaker.

The described systems, apparatuses, components thereof which are described herein may be manufactured and sold together, manufactured and sold separately for later, integration, or alternatively be manufactured and sold as components which are later integrated into a completed system at manufacture and sold as a system, such as in accordance with an embodiment of the system described and claimed herein. For example, the shower barrier having the access opening therethrough may be manufactured and sold separately and later used or implemented in the manner taught and claimed, for example, by hanging in a vertical plane anterior to a shower recess.

In the following description, numerous specific details are set forth such as examples materials and uses, etc., in order to provide a thorough understanding of the various embodiments of the present invention. It will be apparent, however, to one skilled in the art that these specific details need not be employed to practice the disclosed embodiments of the present invention. In other instances, well known materials or methods have not been described in detail in order to avoid unnecessarily obscuring the disclosed embodiments.

FIG. 1 illustrates an exemplary architecture 100 in which embodiments of the present invention may operate. Architecture 100 depicts a shower barrier 105 having an access opening 110 therethrough. Shower barrier 105 includes a mechanism to hang 115 the shower barrier 105 in a vertical plane 120 anterior 125 to a shower recess (e.g., the shower barrier 105 to hang "in front of" or "anterior to" a shower recess.

The shower barrier 105 includes the access opening 110 as shown, which may include, for example, a hole, an opening, a void, empty space through the shower barrier 105, an access portal, or other means that allows access through an anterior 125 face 130 of the shower barrier 105 to the posterior side 130 of (e.g., "in back of" or "behind") the shower barrier 105, thus resulting in access to an interior of a shower recess when the shower barrier 105 is hanging in a vertical plane 120 anterior 125 to such a shower recess.

In such an embodiment, the claimed shower barrier 105 further restricts water originating interior to the shower recess from egress from the shower recess.

Further depicted in FIG. 1 are various elements that aid in demonstrating the origination and position of the shower barrier 105, for example, the orientation of the shower barrier 105 while in use or prepared for use or in anticipation of use. Thus, depicted relative to the depicted embodiment of the shower barrier 105 of FIG. 1 is a superior end 135 (e.g., a "top" end), an inferior end 140 (e.g., a "bottom" or "lower" end), a first lateral side 145 (e.g., a "lateral left" side or "left side"), and a second lateral side 150 (e.g., a "lateral right" or "right side"). Further depicted is the horizontal plane 155.

Along the superior end 135 of the shower barrier 105 traversing the horizontal plane 155 are multiple hanging mechanisms 115 which illustrate a variety of mechanisms by which the shower barrier 105 may be hung in the vertical plane 120. For example, depicted in accordance with one embodiment are several reinforced eyelet hanging mechanisms 115 traversing a top-most superior edge 135 portion of the shower barrier 105 relative to the shower barrier 105 hung in the vertical plane 120 to hang the shower barrier 105 in the vertical plane 120 anterior 125 to a shower recess. In an alternative embodiment, the hanging mechanisms 115 constitute looped straps. In another embodiment, the hanging mechanisms 115 are hooks.

In a particular embodiment, shower barrier 105 further includes an additional flap or cover integrated with, or coupled/fastened to the shower barrier and positioned substantially over the access opening 110. In such an embodiment, the additional flap may be oriented in an open or closed position, in which the closed position further restricts water originating interior to a shower recess from escaping the interior of the shower recess through the access opening 110 of the shower barrier 105. In the open position, the additional flap permits access to the access opening 110 in the face 130 of the shower barrier 105.

Figure 2:
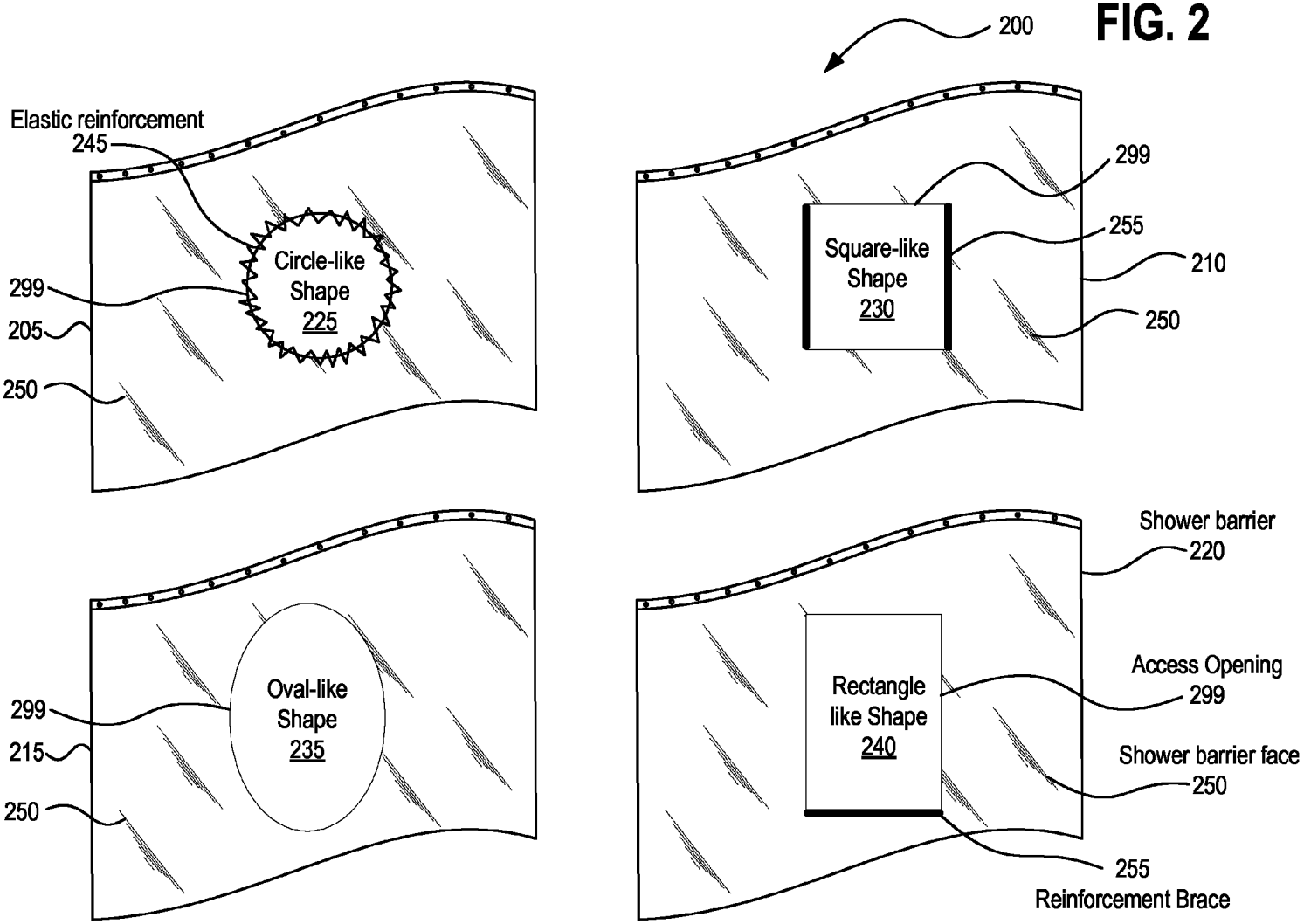
FIG. 2 illustrates alternative exemplary architectures in which embodiments of the present invention may operate.

FIG. 2 illustrates alternative exemplary architectures 200 in which embodiments of the present invention may operate. In particular, architecture 200 includes shower barriers 205, 210, 215, and 220, each of which incorporates an alternative access opening in accordance with embodiments of the present invention.

In accordance with one embodiment, shower barrier 205 includes a circle-like shaped 225 access opening 299 through the face 250 of the shower barrier 205. In accordance with another embodiment, shower barrier 215 includes an oval-like shaped 235 access opening 299 through the face 250 of the shower barrier 215. In accordance with a particular embodiment, shower barrier 210 includes a square-like shaped 230 access opening 299 through the face 250 of the shower barrier 210. In accordance yet another embodiment, shower barrier 220 includes a rectangle-like shaped 240 access opening 299 through the face 250 of the shower barrier 220. The "like" shaped access openings 299 described indicate that the shapes resembles a circle, oval, rectangle, and square shape respectively, but are not necessarily exact, due to, for example, limitations of manufacturing practices. Furthermore, the shapes need not be exact to embody the teachings of the present invention.

In a particular embodiment, the shower barrier (e.g., 205 or 215) includes a circumference of the circle-like 225 or oval-like 235 access opening 299 through the face 250 of the shower barrier, and the circumference includes an elastic reinforcement 245 at least partially around the circumference or perimeter to at least partially cinch, toward a center of the access opening relative to the vertical plane, the circle-like or oval-like opening inward at least partially reducing the circumference. In an alternative embodiment, a circumference of the circle-like or oval-like opening through the face of the shower barrier includes an elastic reinforcement to maintain a shape of the circle-like or oval-like opening (e.g., as opposed to cinching or reducing the circumference). For example, in one embodiment, an elastic material is integrated into an inferior or lower portion of the circumference, such as a bottom quarter or fifth of the lower portion of the perimeter. In another embodiment, the elastic fully surrounds the perimeter. In yet another embodiment, the elastic surrounds an approximately bottom half of the perimeter.

In a particular embodiment, an elastic material is further integrated into an inferior most bottom edge of the shower barrier in a vertical plane, the elastic material integrated along the bottom horizontal edge, and further integrated is an attaching means (e.g., hooks, Velcro™ etc.) to anchor or secure the shower barrier to a wall of the shower recess to maintain the shower barrier in a taught or straight position to minimize water from escaping the shower recess. For example, hooks or other securing means may be located at each bottom corner of the shower barrier to anchor or secure each corner to the shower recess, for example, such as the securing means depicted by element 195 at each corner of the shower barrier.

Various materials having an elastic property may be employed that cause the opening to cinch at least partially closed. In such an embodiment, the elastic reinforcement 245 of the circumference resists elongation of the circle-like or oval-like openings and re-cinches the circle-like or oval-like openings in the absence of an opposing and/or elongating force.

In one embodiment, the shower barrier (e.g., 210 or 220) having the square-like 230 or rectangular-like 240 shaped access opening 299 includes either the elastic reinforcement as depicted at element 245 relative to shower barriers 205 and 215, to at least partially cinch a perimeter of the square-like or rectangular-like shaped access opening inward at least partially reducing the perimeter or alternatively, the square-like 230 or rectangular-like 240 shaped access opening 299 includes one or more rigid reinforcement braces 255 to resist the square-like 230 or rectangular-like 240 shaped access opening 299 from collapsing inward. For example, a reinforcing bar, brace, splint, or other rigid material may be utilized and, for example, coupled with, or sewn, or otherwise secured to the shower barrier (e.g., 210 and 220). Vertically oriented reinforcing braces 255 permit the shower barrier to open or slide across a horizontal plan without obstruction, as the reinforcing brace(s) 255 will not obstruct or resist folding or collapsing of the shower barrier in a vertical orientation, while horizontally oriented reinforcing brace(s) 255 provide additional support around an access opening 299 within a shower barrier to resist vertically downward sagging, and may optionally be hinged or constructed in a manner that permits horizontal folding with the shower barrier.

In an alternative embodiment, instead of an access opening 299, the shower barrier instead includes a vertical slit relative to the shower barrier hung in the vertical plane. In one embodiment, the vertical slit traverses an entire height of the shower barrier, and a first lateral side of the shower barrier is coupled with a second lateral side of the shower barrier via one or more connecting mechanisms. Connecting mechanism may include zippers, hook and loop fasteners (e.g., "Velcro™" brand or similarly hook/loop compatible fasters), snaps, loops, ties, etc. When decoupled, each of the first and second lateral side of the shower barrier may then be coupled to itself or coupled to a shower recess so that it does not obstruct assess to the interior of a shower recess.

Figure 3:
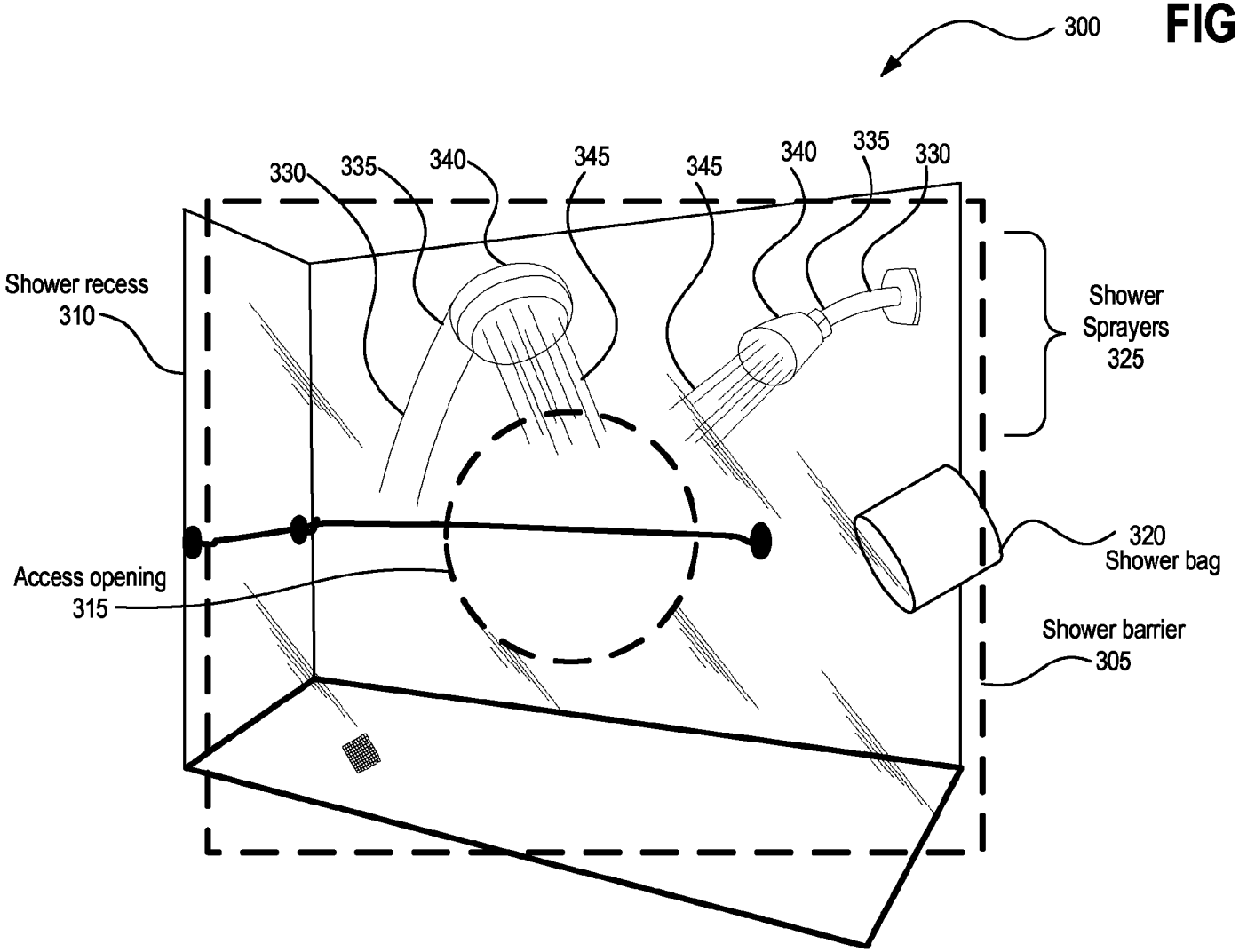
FIG. 3 illustrates a system in accordance with embodiments of the present invention.

FIG. 3 illustrates a system 300 in accordance with embodiments of the present invention. In particular, illustrated is a shower system 300 having a shower barrier 305 to hang in a vertical plane anterior to a shower recess 310, and in which the shower barrier 305 includes an access opening 315 therethrough (e.g., an access opening through an anterior face of the shower barrier 305). In such an embodiment, the shower barrier 305 is to restrict water interior to the shower recess 310 from egress from the shower recess 310. For example, water associated with water flow depicted at element 345 is blocked, impeded, stopped, or at least partially restricted from exiting the shower recess 310.

The shower system 300 further includes a shower bag 320 to receive a shower sprayer 325 from interior to the shower recess 310. In one embodiment, the shower bag 320 is to deflect a water flow 345 from the shower sprayer 325 while the shower bag 320 is in a collapsed orientation. In such an embodiment, the shower bag 320 does not deflect or otherwise affect the water flow 345 from the shower sprayer 325 while in an elongated orientation. The elongated and collapsed orientations of the shower bag 320 are described and depicted in additional detail with respect to FIGS. 4 and 5 below.

Further depicted within shower system 300 are shower sprayers 325, each having a handle and/or shaft 330 portion, each having a neck portion 335, in which the neck portion is below or behind a shower head portion 340 as shown. Further depicted is a water flow 345 emanating or originating from the respective shower sprayers 325. In one embodiment, the shower bag 320 is to receive a shower sprayer 325 and to couple with a shower sprayer 325 as is described in additional detail below.

Figure 4:
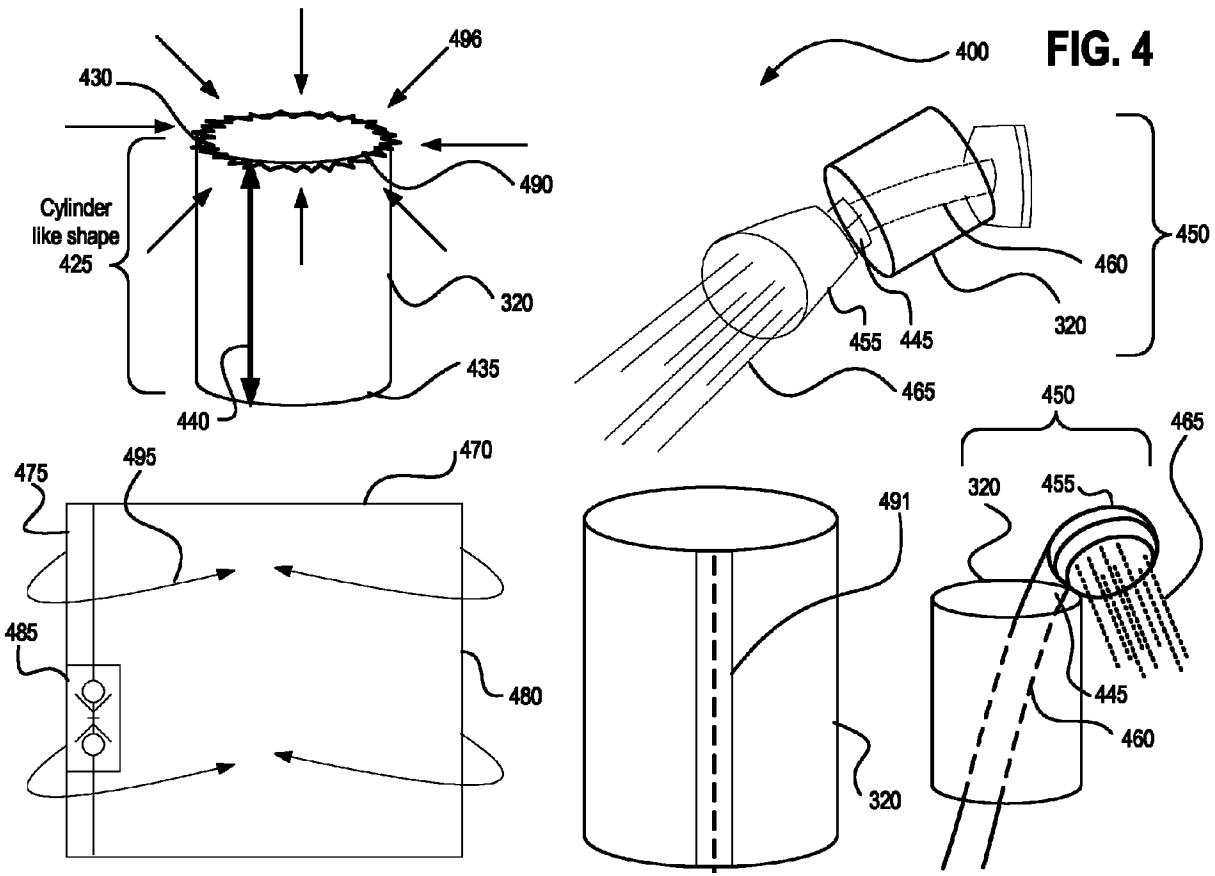
FIG. 4 illustrates various implementation details of described embodiments of the present invention.

FIG. 4 illustrates various implementation details 400 of described embodiments of the present invention. In particular, the implementation details 400 of shower bag 320 are depicted and described.

In one embodiment, the shower bag 320 (e.g., as taught and claimed relative to system 300, method 600, in isolation as a separate and distinct shower bag 320, or relative to shower barrier apparatus 105) is in an elongated orientation. In such an embodiment, the elongated origination includes a cylindrical-like shape 425 having a topmost superior end 430 and a bottom most inferior end 435 relative to the shower bag 320 in a vertical orientation 440. In such an embodiment, the topmost superior end 430 of the shower bag is to couple with a neck portion and/or area 445 of a shower sprayer 450 below a shower head 455 of the shower sprayer 450. In a particular embodiment, an interior chamber of the cylindrical-like shape 425 of the shower bag 320 is to surround a shaft and/or handle 460 of the shower sprayer 450.

In one embodiment, the shower bag 320 is to deflect a water flow 465 from the shower sprayer 450 while the shower bag 320 is in a collapsed orientation. In a particular embodiment, the shower bag 320 is to intercept the water flow 465 from the shower sprayer 450 via an inward facing plane of the shower bag 320 while in a collapsed orientation. In such an embodiment, the inward facing plane of the shower bag 320 is substantially parallel to a shower head 455 of the shower sprayer 450 from which the water flow 465 emanates. In one embodiment, the inward facing plane of the shower bag 320 in the collapsed orientation is the same outward facing plane of the same shower bag 320 when the shower bag 320 is in an elongated orientation. For example, while unfolded or elongated, the exterior or outward facing plane faces away from the shower sprayer 450, but the same plane is then directed inward, becoming an inward facing plane, by folding the shower bag 320 up and over the shower head 455 of the shower sprayer 450, putting the shower bag 320 into a collapsed or folded-over orientation, and resulting in the previously exterior or outward facing plane becoming an interior or inward facing plane.

In one embodiment, the shower bag 320 is made of a flattened material 470 formed into a cylindrical-like shape 425. For example, in one embodiment, a first lateral side 475 of the flattened material 470 and a second lateral side 480 of the flattened material 470 is to couple with each other to form the cylindrical-like shape 425, such as that depicted by the inward curving arrows 495 wrapping around the flattened material at element 470. Flattened material may be, for example, in the form of a sheet. Securing each lateral end together causes a seam at 491 as depicted.

In one embodiment, coupling each of the first and second lateral edges (475 and 480) of the flattened material 470 is accomplished through the use of, for example, a zipper 485, a glued seam, a sewn seam, etc. In a particular embodiment, the shower bag 320 includes a pliable hook-and-loop fastener strip (e.g., a "Velcro™" strip) to couple the first lateral side 475 to the second lateral side 480 of the flattened material 470 to form the cylindrical-like shape 425. The secured lateral edges 475 and 480 thus result in seam 491.

In one embodiment, the shower bag 320 is to couple with, attach, fasten, secure, etc., to a neck portion or area 445 of a shower sprayer 450. In one embodiment, the shower bag 320 has an integrated elastic perimeter/circumference 490 at a top-most superior end 430 of the shower bag 320 while in an elongated and vertical orientation, in which the integrated elastic perimeter/circumference 490 couples, secures, fastens the shower bag 320 to the shower sprayer 450 at the neck portion 445. The elastic perimeter/circumference 490 serves to reduce the perimeter at the top-most superior end 430 of the shower bag 320, causing it to, for example, cinch into the neck portion 445 of the shower sprayer 450 causing it to be held in place, as depicted by the multiple inward facing arrows 496 surrounding the perimeter at the top-most superior end 430 of the shower bag 320.

In an alternative embodiment, a hook and loop strip mechanism (e.g., "Velcro™") is used to fasten or couple the topmost superior end 430 (in a vertical and elongated orientation) of the shower bag 320 with the shower sprayer 450 at the neck portion 445. Other fastening, coupling, or securing means may obviously be chosen in accordance with the scope of the claimed invention.

Figure 5:
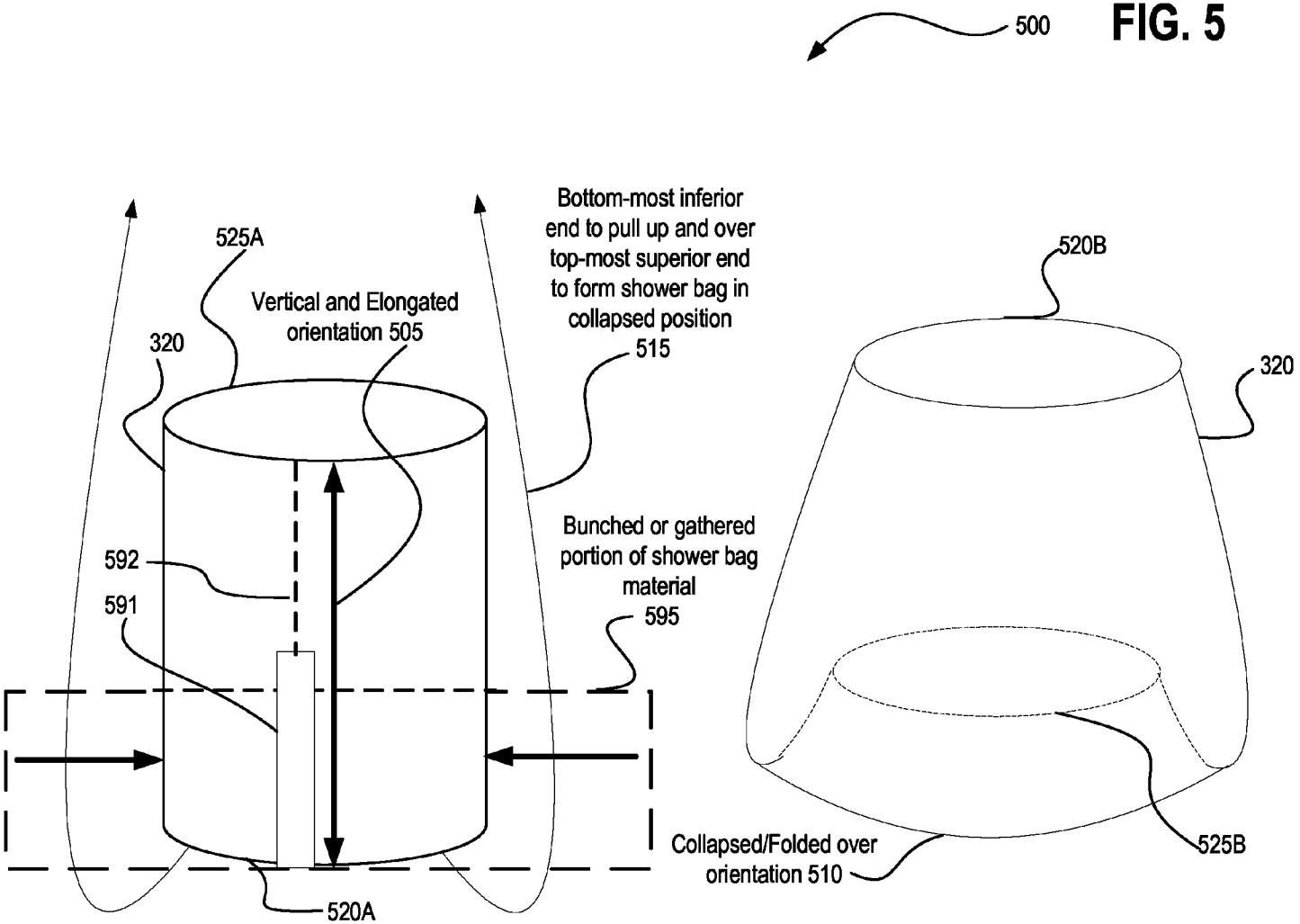
FIG. 5 illustrates elongated and collapsed orientations of a claimed shower bag in accordance with embodiments of the present invention.

FIG. 5 illustrates elongated and collapsed orientations 500 of a claimed shower bag in accordance with embodiments of the present invention. In particular, the same shower bag 320 is depicted in two separate and distinct orientations, a collapsed orientation at element 510 and an elongated/vertical orientation at element 505.

In one embodiment, the shower bag 320 in the collapsed orientation 510 constitutes the shower bag 320 formed into a cylindrical-like shape having a topmost superior end and a bottom most inferior end relative to the shower bag in a vertical orientation, in which the bottom most inferior end of the shower bag to reversibly pull up and over the topmost superior end of the shower bag and up and over a shower head of a shower sprayer as depicted by the upward curving arrows at element 515. The shower bag 320 in the collapsed orientation 510 thus has a first end 520B which corresponds to a first end 520A of the same shower bag 320 in an elongated/vertical orientation, and a second end 525B which corresponds to a second end 525A of the same shower bag 320 in the elongated/vertical orientation.

In one embodiment, the shower bag 320 in the collapsed orientation 510, pulled up and over the head of a shower sprayer, is to deflect a water flow from the shower sprayer, as the flattened material of the shower bag 320 is physically surrounding the shower head of the shower sprayer in such a collapsed orientation 510, and thus blocks or impedes the water flow emanating from the shower sprayer, thus causing the water flow to deflect and flow down and out of the shower bag 320 in a direction that is different from an original direction of the water flow.

In a particular embodiment, the shower bag 320 has both a superior end and an inferior end when the bag is in a vertical orientation and elongated. In this embodiment, the shower bag 320 includes a bottom third to half of the material constituting the shower bag gathered or bunched causing the shower bag to gather or bunch inward and tightly against and around at least a substantial portion of sprayer handle 460 or to bunch tightly around the handle 460 of the shower sprayer 450 and additionally bunch around the neck portion 445 of the shower sprayer 450, thus causing the shower bag to cling to the shower sprayer in an elongated position/orientation.

In an alternative embodiment, a non-skid, non-slip, rubberized synthetic material is fastened to the interior of the shower bag in the bunched and gathered area in the bottom third to half of the shower bag to further prevent slippage between the shower bag 320 and the sprayer handle 460 when the shower bag 320 is in either an elongated 505 or a folded over orientation 510. For example, element 595 with the inward pointing bunching arrows, depicts a lower approximately third portion of the shower bag 320 that may be bunched or gathered. For example, bunching or gathering material, such as terry cloth or other suitable material may be accomplished be sewing lines horizontally (e.g., perpendicularly) across the portion of the material to be bunched, and then synching the sewing string tighter to reach the desired bunched width and the desired amount of bunching or gathering, and then securing the sewing string causing the material to remain in a bunched state.

In a particular embodiment, an securable seam 591 that can be opened and closed or attached and unattached, for example, via Velcro™ is integrated thus allowing the shower sprayer to be inserted into the shower bag and a second seam 592 is permanently fixed in the shower bag, for example, via a sewn seam into the material joining two opposing lateral edges or sides.

Figure 6:
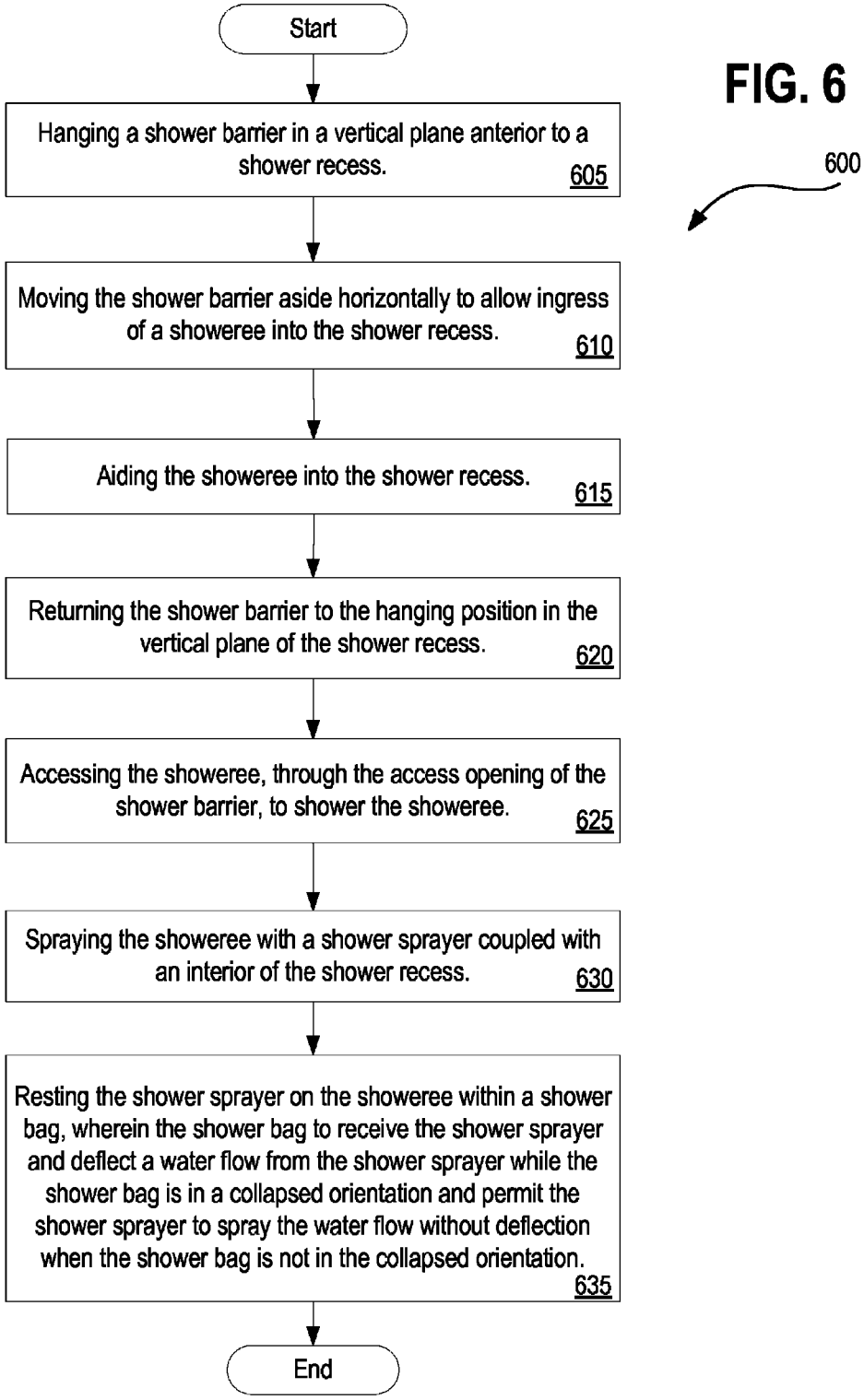
FIG. 6 is a flow diagram illustrating a method for using a claimed shower barrier and shower bag in accordance with one embodiment of the present invention.

FIG. 6 is a flow diagram illustrating a method 600 for using a claimed shower barrier and shower bag in accordance with one embodiment of the present invention, such as shower bag 320 and shower barrier 305 depicted relative to system 300 at FIG. 3, or shower barrier 105 of FIG. 1 and shower bag 320 of FIG. 5, each depicted in greater detail individually.

Method 600 begins with block 605 by hanging a shower barrier in a vertical plane anterior to a shower recess. In such an embodiment, the shower barrier includes an access opening through a face of the shower barrier. In this embodiment, the shower barrier further restricts water interior to the shower recess from exiting the shower recess.

Block 610 describes moving the shower barrier aside horizontally to allow ingress of a showeree into the shower recess. In one embodiment, the showeree is a patient. In another embodiment, the showeree is an elderly person or a disabled person. In a particular embodiment, the showeree is a pet, such as a family dog, and all of the above teachings are equally applicable. Similarly, the showeree may be a child. Moreover, in such an embodiment, a home healthcare provider, a hospital nurse, a residential treatment nurse, a home healthcare nurse, a home healthcare aid, or a caretaker, accesses the showeree through the access opening of the shower barrier.

Block 615 describes aiding the showeree into the shower recess (e.g., a bathtub, a shower stall, a shower partition, etc.). Block 620 describes returning the shower barrier to the hanging position in the vertical plane of the shower recess, and block 625 describes accessing the showeree, through the access opening of the shower barrier, to shower and/or bathe the showeree. For example, a caretaker, home nurse, hospital nurse, parent, etc. may access the showeree to aid the showeree in its hygienic needs.

Block 630 describes spraying the showeree with a shower sprayer coupled with an interior of the shower recess, in which the shower sprayer is accessed by, for example, a caretaker through the access opening of the shower barrier. Notably, the caretaker in such an example is able to remain outside, or exterior to the shower recess, but reach into the interior of the shower recess to aid in showering the showeree. In such a way, the caretaker is able to remain dry, as the shower barrier is not required to be moved aside horizontally while showering the showeree, as is done with conventional solutions. In this way, the caretaker remains dry or significantly drier compared to such conventional solutions because water escaping the interior of the shower recess is significantly reduced, restricted, or blocked by the described shower barrier. Additionally, privacy for the showeree is greatly improved, as it is not necessary to fully expose the showeree by having a conventional shower curtain fully opened or pulled aside horizontally as is done with conventional solutions, thus, potentially improving caretaker to patient relations and comfort. Such improvements benefit those community members requiring the aid of a caretaker in fulfillment of their personal hygienic needs and address a longstanding need that has heretofore gone unfulfilled by conventional solutions.

The shower sprayer may be coupled directly to a shower recess, as with a wall mounted shower sprayer, or may be coupled with a shower recess via a shower sprayer hose extension, such as with a hand-held shower sprayer that may be positioned in a coupling on a wall of a shower recess, or removed from such a coupling and held as a hand-held shower sprayer.

Ending with block 635, the block describes resting the shower sprayer (e.g., a hand-held shower sprayer coupled with the shower recess via a hose) on the showeree (e.g., on a shoulder or arm of a human showeree) within a shower bag. For example, to free the hands of the caretaker from holding a hand-held shower sprayer, and further allowing a water flow from the shower sprayer to be obstructed by a shower bag in a collapsed orientation so that the water flow does not spray the showeree or the caretaker in an undesired manner (e.g., so that neither party is sprayed unintentionally).

In such an embodiment, the shower bag receives or at least partially surrounds the shower sprayer and deflects the water flow from the shower sprayer while the shower bag is in a collapsed orientation (e.g., a folded over orientation). In such an embodiment, the shower bag further permits the shower sprayer to spray the water flow without deflection when the shower bag is not in the collapsed orientation, such as when the shower bag is in an elongated or unfolded orientation, given that the shower bag will reside substantially around a shaft or handle portion of the shower sprayer in the elongated position rather than folded up and over a shower head of a shower sprayer as when in the elongated or unfolded position.

The above description is intended to be illustrative, and not restrictive. Many other embodiments will be apparent to those of skill in the art upon reading and understanding the above description. The scope of the invention is therefore determined in reference to the appended claims, along with the full scope of equivalents to which such claims are entitled.

What is claimed is:

1. A shower barrier comprising:

a mechanism to hang the shower barrier in a vertical plane anterior to a shower recess;

an access opening through a face of the shower barrier, the access opening defining a perimeter, and wherein the perimeter comprises an elastic reinforcement at least partially around the perimeter to at least partially cinch the opening inward, toward a center of the access opening relative to the vertical plane, at least partially reducing the perimeter, and wherein the elastic reinforcement of the perimeter resists elongation of the opening and re-cinches the opening in the absence of an opposing and/or elongating force; and wherein the shower barrier restricts water interior to the shower recess from egressing from the shower recess.

2. The shower barrier of claim 1, wherein the access opening comprises a generally circular opening through the face of the shower barrier.

3. The shower barrier of claim 1, wherein the opening through the face of the shower barrier comprises a generally oval opening through the face of the shower barrier.

4. The shower barrier of claim 1:

wherein the opening through the face of the shower barrier comprises a generally square opening.

5. The shower barrier of claim 1, wherein the opening through the face of the shower barrier comprises rectangular.

6. The shower barrier of claim 1, wherein the shower barrier defines a bottom edge and the shower recess comprises at least one wall and further comprising an attaching means adjacent the bottom edge of the shower barrier to secure the shower barrier to the wall.

7. The shower barrier of claim 1, wherein the shower barrier further comprises an additional flap to cover the access opening when in a closed orientation.

8. The shower barrier of claim 7, wherein the additional flap, when oriented in the closed position further restricts water originating interior to the shower recess from escaping the interior of the shower recess through the access opening, and wherein the additional flap, when oriented in an open position, permits access to the access opening of the shower barrier.

9. The shower barrier of claim 1, wherein the shower barrier defines a bottom edge and two bottom corners, and the shower recess comprises a pair of opposed walls, and further comprising a pair of attaching means adjacent the bottom edge, each attaching means adjacent one of the bottom corners of the shower barrier, to secure the shower barrier adjacent the bottom corners to the walls.

10. A shower system comprising:

a shower barrier to hang in a vertical plane anterior to a shower recess, the shower barrier comprising an access opening through a face of the shower barrier, wherein the shower barrier to restrict water interior to the shower recess from egress from the shower recess;

a shower bag to receive a shower sprayer from interior to the shower recess, the shower bag to deflect a water flow from the shower sprayer in a collapsed orientation and wherein the shower bag to not deflect or otherwise affect the water flow from the shower sprayer in an elongated orientation.

11. The shower system of claim 10, wherein the shower bag in the elongated orientation comprises a cylindrical-like shape having a topmost superior end and a bottom most inferior end relative to the shower bag in a vertical orientation, wherein the topmost superior end of the shower bag is to couple with a neck of the shower sprayer below a shower head of the shower sprayer, and wherein an interior chamber of the cylindrical-like shape of the shower bag to surround a shaft and/or handle of the shower sprayer.

12. The shower system of claim 10, wherein the shower bag to deflect the water flow from the shower sprayer in the collapsed orientation comprises the shower bag to intercept the water flow from the shower sprayer via an inward facing plane of the shower bag in the collapsed orientation, the inward facing plane of the shower bag substantially parallel to a sprayer head of the shower sprayer from which the water flow emanates, and wherein the inward facing plane of the shower bag in the collapsed orientation shower comprises an outward facing plane of the same shower bag in the elongated orientation.

13. The shower system of claim 12, wherein the shower bag in the collapsed orientation comprises a cylindrical-like shape having a topmost superior end and a bottom most inferior end relative to the shower bag in a vertical orientation, wherein the topmost superior end of the shower bag is to couple with a neck of the shower sprayer below a shower head of the shower sprayer, and wherein the bottom most inferior end of the shower bag to reversibly pull up and over the topmost superior end of the shower bag and up and over a shower head of the shower sprayer to deflect the water flow from the shower sprayer.

14. The shower system of claim 10, wherein the shower bag comprises a flattened material formed into a cylindrical-like shape, wherein a first lateral side of the flattened material and a second lateral side of the flattened material to couple with each other to form the cylindrical-like shape.

15. The shower system of claim 14, wherein the shower bag comprises a pliable hook-and-loop fastener strip to couple the first lateral side to the second lateral side of the flattened material to form the cylindrical-like shape.

16. A method comprising:

hanging a shower barrier in a vertical plane anterior to a shower recess, wherein the shower barrier comprises an access opening through a face of the shower barrier, the access opening defining a perimeter, and wherein the perimeter comprises an elastic reinforcement at least partially around the perimeter to at least partially cinch the opening inward, toward a center of the access opening relative to the vertical plane, at least partially reducing the perimeter, and wherein the elastic reinforcement of the perimeter resists elongation of the opening and re-cinches the opening in the absence of an opposing and/or elongating force, and wherein the shower barrier restricts water interior to the shower recess from exiting the shower recess;

moving the shower barrier aside horizontally to allow ingress of a showeree into the shower recess;

aiding the showeree into the shower recess;

returning the shower barrier to the hanging position in the vertical plane of the shower recess; and accessing the showeree, through the access opening of the shower barrier, to shower the showeree.

17. The method of claim 16, wherein accessing the showeree, through the access opening of the shower barrier, to shower the showeree comprises:

spraying the showeree with a shower sprayer coupled with an interior of the shower recess;

resting the shower sprayer on the showeree within a shower bag, wherein the shower bag to receive the shower sprayer and deflect a water flow from the shower sprayer while the shower bag is in a collapsed orientation and permit the shower sprayer to spray the water flow without deflection when the shower bag is not in the collapsed orientation.

18. The method of claim 16, wherein accessing the showeree, through the access opening of the shower barrier, to shower the showeree comprises: a home healthcare provider, a hospital nurse, a residential treatment nurse, a home healthcare nurse, a home healthcare aid, or a caretaker to access a patient through the access opening of the shower barrier.

19. The method of claim 16, wherein the showeree comprises an entity selected from the group comprising:

a patient;

an elderly person;

a disabled person;

a pet; and a child.

20. The shower barrier of claim 9 further comprising an elastic material adjacent the bottom edge of the shower barrier extending from adjacent one bottom corner to adjacent the other bottom corner.

* * * * *